US008797368B2

(12) United States Patent
Yoo et al.

(10) Patent No.: US 8,797,368 B2
(45) Date of Patent: Aug. 5, 2014

(54) ORGANIC LIGHT-EMITTING DISPLAY DEVICE AND DRIVING METHOD THEREOF

(75) Inventors: Gi-Na Yoo, Yongin (KR); Seung-Jae Jeong, Yongin (KR); Min-Jae Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 628 days.

(21) Appl. No.: 12/888,308

(22) Filed: Sep. 22, 2010

(65) Prior Publication Data

US 2011/0216097 A1 Sep. 8, 2011

(30) Foreign Application Priority Data

Mar. 3, 2010 (KR) ..... 10-2010-0019028

(51) Int. Cl.
*G09G 5/10* (2006.01)
*G09G 3/30* (2006.01)

(52) U.S. Cl.
USPC ..... 345/690; 345/76; 345/77; 345/89

(58) Field of Classification Search
CPC ..... G09G 5/10; G09G 3/30
USPC ..... 345/76, 690, 77, 89; 382/167
See application file for complete search history.

(56) References Cited

U.S. PATENT DOCUMENTS 6,101,272 A 8/2000 Noguchi
2008/0150844 A1* 6/2008 Choi ..... 345/76
2009/0033682 A1* 2/2009 Kaida et al. ..... 345/634
2009/0040151 A1 2/2009 Lee
2009/0135107 A1* 5/2009 Kim ..... 345/76
2009/0154805 A1* 6/2009 Cok et al. ..... 382/167
2010/0289727 A1* 11/2010 Miller et al. ..... 345/76
2011/0187754 A1* 8/2011 Yoo ..... 345/690

FOREIGN PATENT DOCUMENTS

JP 10-229502 8/1998
KR 10-2009-0015302 2/2009
KR 10-2009-0129471 12/2009
WO WO 2008/127559 A1 10/2008

OTHER PUBLICATIONS

KIPO Notice of Allowance dated Aug. 24, 2011, for Korean Priority Patent Application No. 10-2010-0019028, 5 pages.

* cited by examiner

*Primary Examiner* — Amare Mengistu
*Assistant Examiner* — Jennifer Zubajlo
(74) *Attorney, Agent, or Firm* — Christie, Parker & Hale, LLP

(57) ABSTRACT

An organic light-emitting diode (OLED) display device capable of reducing power consumption within a range in which an image quality is not lowered, and a method of driving the OLED display device. The OLED display device includes: an image analyzer for obtaining an emission ratio and a saturation of an input source image, the emission ratio indicating light-emitted degrees of pixels constituting the input source image; an emission ratio adjuster for adjusting the emission ratio according to the saturation; a brightness adjuster for adjusting the brightness of the input source image according to the adjusted emission ratio; a data driver for establishing a data voltage of a data signal corresponding to the input source image based on the adjusted original brightness; and a pixel unit including an organic light-emitting diode (OLED), the pixel unit being configured to establish a driving current according to the data voltage.

18 Claims, 6 Drawing Sheets

| Emission ratio | Brightness ratio |
|---|---|
| 0.0% | 100.0% |
| 10.0% | 95.0% |
| 20.0% | 90.0% |
| 30.0% | 85.0% |
| 40.0% | 80.0% |
| 50.0% | 75.0% |
| 60.0% | 70.0% |
| 70.0% | 65.0% |
| 80.0% | 60.0% |
| 90.0% | 55.0% |
| 100.0% | 50.0% |

| Emission ratio | Brightness ratio |
|---|---|
| 0.0% | 100.0% |
| 10.0% | 95.0% |
| 20.0% | 90.0% |
| 30.0% | 85.0% |
| 40.0% | 80.0% |
| 50.0% | 75.0% |
| 60.0% | 70.0% |
| 70.0% | 65.0% |
| 80.0% | 60.0% |
| 90.0% | 55.0% |
| 100.0% | 50.0% |

| Emission ratio | Brightness ratio |
|---|---|
| 0.0% | 100.0% |
| 10.0% | 100.0% |
| 20.0% | 100.0% |
| 30.0% | 100.0% |
| 40.0% | 96.0% |
| 50.0% | 92.0% |
| 60.0% | 87.0% |
| 70.0% | 83.0% |
| 80.0% | 79.0% |
| 90.0% | 74.0% |
| 100.0% | 70.0% |

FIG. 7

| | | IMAGE1 | IMAGE2 | IMAGE3 | IMAGE4 |
|---|---|---|---|---|---|
| EMISSION RATIO (Emission ratio, %) | | 50 | 50 | 50 | 50 |
| S*uv | | 0.3 | 1.7 | 1.5 | 0.6 |
| CASE (A) NOT APPLYING ACL | POWER CONSUPMTION(mW) | 157.44 | 126.85 | 104.32 | 122.17 |
| CASE (B) APPLYING GENERAL ACL | ADJUSTED BRIGHTNESS (Brightness ratio(1), %) | 75 | 75 | 75 | 75 |
| | POWER CONSUPMTION(mW) | 118.08 | 94.76 | 78.24 | 91.63 |
| CASE (C) APLLYING ACL ACCORDING TO EMBODIMENT OF THE PRESENT INVENTION | ADJUSTED BRIGHTNESS (Brightness ratio(2), %) | 75 | 70 | 70 | 75 |
| | POWER CONSUPMTION(mW) | 118.08 | 88.445 | 73.024 | 91.63 |

Brightness ratio(1) = Emission ratio*(−0.5)+1

Brightness ratio(2) = if S*uv>1, Emission ration α*(−0.5)+1 if S*uv<=1, Emission ratio * (−0.5)+1

ORGANIC LIGHT-EMITTING DISPLAY DEVICE AND DRIVING METHOD THEREOF

CROSS-REFERENCE TO RELATED PATENT APPLICATION

This application claims priority to and the benefit of Korean Patent Application No. 10-2010-0019028, filed on Mar. 3, 2010, in the Korean Intellectual Property Office, the entire content of which is incorporated herein by reference.

BACKGROUND

1. Field

The following description relates to an organic light-emitting diode (OLED) display device and a driving method thereof, and more particularly, to an OLED display device capable of reflecting a saturation of a source image to change the brightness of the source image in order to reduce or minimize power consumption within a range in which lowering of an image quality perceived by a user is reduced or minimized, and a driving method thereof.

2. Description of the Related Art

Flat panel display (FPD) devices such as liquid crystal display (LCD) devices, plasma display panel (PDP) devices, field emission display (FED) devices, or the like have been developed to overcome the disadvantages of cathode ray-tube (CRT) display devices. Among these display devices, an organic light-emitting diode (OLED) display device, which has high luminous efficiency, high luminance, wide viewing angles, and fast response times, has attracted attention as a next generation display device.

The OLED display device displays an image using an organic light-emitting diode (OLED) which generates light through a recombination of electrons and holes. The OLED display device has fast response times and is driven with low power consumption.

SUMMARY

Aspects of embodiments of the present invention are directed toward an organic light-emitting diode (OLED) display device capable of improving an image quality and reducing power consumption using an auto current limit (ACL) algorithm for changing the brightness of an image within a range in which lowering of the image quality perceived by a user is reduced or minimized, and a driving method thereof.

According to an embodiment of the present invention, there is provided an organic light-emitting diode (OLED) display device including: an image analyzer for obtaining an emission ratio and a saturation of an input source image, the emission ratio indicating light-emitted degrees of pixels constituting the input source image; an emission ratio adjuster for adjusting the emission ratio according to the saturation; a brightness adjuster for adjusting the brightness of the input source image according to the adjusted emission ratio; a data driver for establishing a data voltage of a data signal corresponding to the input source image based on the adjusted original brightness; and a pixel unit including an organic light-emitting diode (OLED), the pixel unit being configured to establish a driving current according to the data voltage and to receive a scan signal, an emission control signal, and the data signal in order to allow the OLED to emit light.

In one embodiment, the emission ratio is an average of values for indicating the light-emitted degrees of the pixels constituting the input source image.

In one embodiment, the saturation of the source image is an average of saturation values of the pixels constituting the input source image.

In one embodiment, if the saturation of the input source image is higher than a reference value set in consideration of the Helmholtz-Kohlrausch (H-K) effect, the emission ratio adjuster is configured to increase the emission ratio.

In one embodiment, the brightness adjuster is configured to decrease the brightness of the input source image by a brightness reduction ratio proportional to the emission ratio of the input source image.

In one embodiment, if the emission ratio of the input source image is lower than the reference value, the brightness adjuster is configured not to change the brightness of the input source image.

According to an embodiment of the present invention, there is provided a method of driving an OLED display device, The method includes: obtaining an emission ratio and a saturation of an input source image, the emission ratio indicating light-emitted degrees of pixels constituting the input source image; adjusting the emission ratio according to the saturation; adjusting the brightness of the input source image according to the adjusted emission ratio; establishing a data voltage of a data signal corresponding to the input source image based on the adjusted brightness; and displaying an image corresponding to a scan signal, an emission control signal, and the data voltage.

In one embodiment, the emission ratio is an average of values for indicating the light-emitted degrees of the pixels constituting the input source image.

In one embodiment, the saturation of the source image is an average of saturation values of the pixels constituting the input source image.

In one embodiment, the adjusting of the emission ratio includes: increasing the emission ratio if the saturation of the input source image is higher than a reference value set in consideration of the Helmholtz-Kohlrausch (H-K) effect.

In one embodiment, the adjusting of the brightness includes: decreasing the brightness of the input source image by a brightness reduction ratio proportional to the emission ratio of the input source image.

In one embodiment, the adjusting of the brightness includes: maintaining the brightness of the input source image if the emission ratio of the input source image is lower than the reference value.

BRIEF DESCRIPTION OF THE DRAWINGS

The accompanying drawings, together with the specification, illustrate exemplary embodiments of the present invention, and, together with the description, serve to explain the principles of the present invention.

FIG. 7 is a table illustrating brightness ratios of a source image, which are adjusted according to an ACL algorithm, according to an embodiment of the present invention.

DETAILED DESCRIPTION

Figure 1:
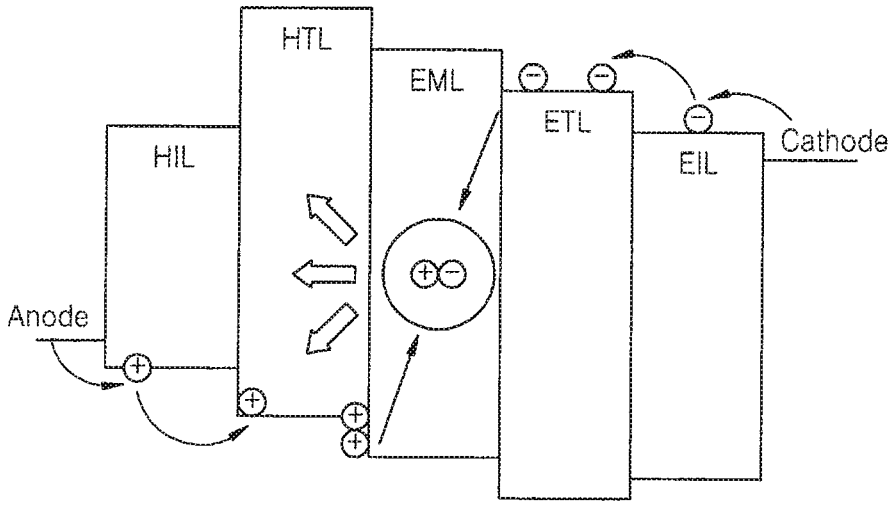
FIG. 1 illustrates an organic light-emitting diode (OLED)

In the following detailed description, only certain exemplary embodiments of the present invention are shown and described, by way of illustration. As those skilled in the art would recognize, the invention may be embodied in many different forms and should not be construed as being limited to the embodiments set forth herein. Like reference numerals designate like elements throughout the specification.

In general, an organic light-emitting diode (OLED) display device electrically excites a fluorescent organic compound to emit light. The OLED display device also applies a voltage or a current to a plurality of organic light-emitting cells arranged in a matrix to drive the plurality of organic light-emitting cells, thereby displaying an image. The organic light-emitting cells have diode characteristics and thus are referred to as organic light-emitting diodes (OLEDs).

Also, in general, a consumed current increases when an OLED, in particular, an active matrix OLED (AMOLED), realizes a white color.

In order to complement this, a portable electronic device or a mobile phone using an AMOLED adopts a black-based graphical user interface (GUI). The portable electronic device or the mobile phone also uses an automatic current limit (ACL) function for changing the brightness of information displayed on a display according to the amount of information to adjust power consumed by the display.

Algorithms (hereinafter referred to as ACL algorithms) for realizing ACL functions include an algorithm for adjusting the brightness of a source image according to an emission ratio of the source image. Since such an algorithm reduces the brightness of an image according to an emission ratio of the image to reduce power consumption, the algorithm increases a brightness reduction ratio to the original brightness of an image having a high emission ratio and decreases a brightness reduction ratio to the original brightness of an image having a low emission ratio.

A graph in relation to an ACL algorithm illustrates a relation between an emission ratio and a brightness ratio, wherein the emission ratio is represented on an X-axis of the graph, and the brightness ratio is represented on a Y-axis of the graph. Here, the emission ratio and the brightness ratio are inversely proportional to each other. An inverse proportion curve illustrating the relation between the emission ratio and the brightness ratio is referred to as an ACL curve.

A steep slope of the ACL curve is advantageous in terms of a reduction in power consumption. However, lowering of an image quality perceived by a user may occur due to a reduction in brightness. Thus, a technique for reducing or minimizing the lowering of an image quality should be utilized with an ACL function of reducing power consumption.

In particular, if peak luminance of a display is less than a set or predetermined level (for example, 300 cd/m$^2$), lowering of an image quality perceived by a user increases due to the use of an ACL algorithm. Thus, it is difficult to apply the ACL algorithm.

FIG. 1 illustrates an OLED. Referring to FIG. 1, the OLED includes an anode, an organic thin film, and a cathode (e.g., a metal cathode). The organic thin film includes an emitting layer (EML), an electron transport layer (ETL), and a hole transport layer (HTL) to improve balances between electrons and holes in order to improve emission efficiency. The organic thin film further includes a hole injecting layer (HIL) and/or an electron injecting layer (EIL).

A method of driving an OLED having the above-described structure is classified as a passive matrix method and an active matrix method using a thin-film transistor (TFT) or a metal-oxide-semiconductor field-effect transistor (MOSFET). The passive matrix method involves forming a cathode and an anode that cross or are orthogonal to each other and selecting a line in order to drive an OLED. The active matrix method involves connecting a TFT to an electrode of an OLED (e.g., an anode or an indium tin oxide (ITO) pixel electrode) and driving the OLED according to a voltage maintained by a capacitor connected to a gate of the TFT. The active matrix method includes a voltage driving method in which a signal applied for writing and maintaining a voltage by a capacitor is in a voltage form.

Figure 2:
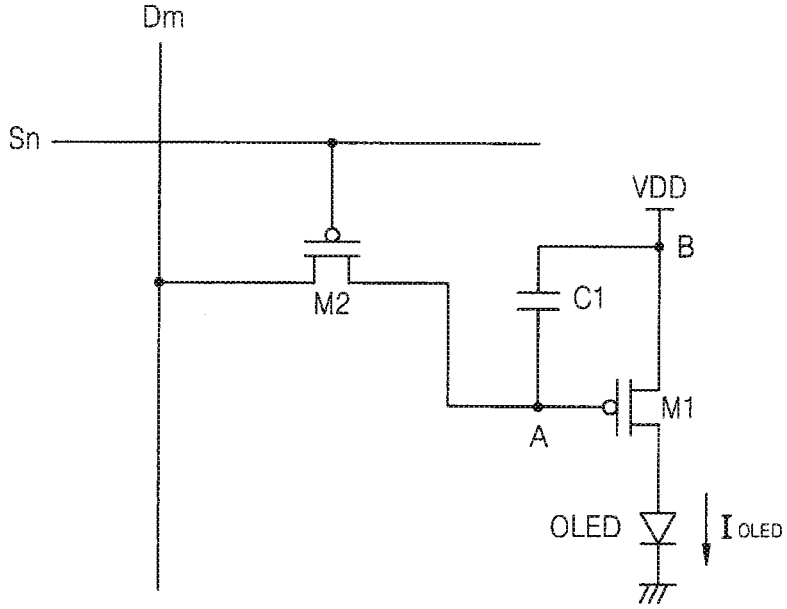
FIG. 2 is a circuit diagram of a pixel circuit for illustrating a voltage driving method.

FIG. 2 is a circuit diagram of a pixel electrode for illustrating the voltage driving method. Referring to FIG. 2, a switching transistor M2 is turned on according to a selection signal of a selection scan line Sn. Thus, a data voltage is transmitted from a data line Dm to a gate of a driving transistor M1, and a potential difference between the data voltage and a power supply voltage VDD is stored in a capacitor C1 connected between the gate and a source of the driving transistor M1. A driving current $I_{OLED}$ flows into an OLED due to the potential difference, and thus the OLED emits light. Here, a set or predetermined gradation is displayed according to a level of the data voltage.

In general, an active matrix organic light-emitting display (AMOLED) device uses an auto current limit (ACL) function for adjusting a light-emitting time of an OLED to adjust power usage of the AMOLED display device in order to reduce power consumption of the AMOLED display. That is, a display driver integrated circuit (IC) generates pulses that may adjust the light-emitting time according to image display data and applies the generated pulses to the AMOLED display, and the AMOLED display shifts the pulses to each of the lines (shift register) to realize the ACL function. The AMOLED display requires a shift register logic in order to propagate the pulses for adjusting the light-emitting time, and the shift register logic may be realized as a complementary metal oxide semiconductor (CMOS) type panel. However, since a p-type metal-oxide semiconductor (PMOS) panel is advantageous in terms of a reduction in a process time and cost in comparison with a CMOS panel, the PMOS panel is utilized in one embodiment.

If the PMOS panel is used, it is difficult to realize the shift register logic for executing the ACL function, and power consumption rapidly increases in a section in which a switch is turned on due to the characteristics of a PMOS transistor, and accordingly, it may be impossible to support the ACL function. In addition, a self-emissive device such as the AMOLED display should include the ACL function for reducing an instant peak current.

Figure 3:
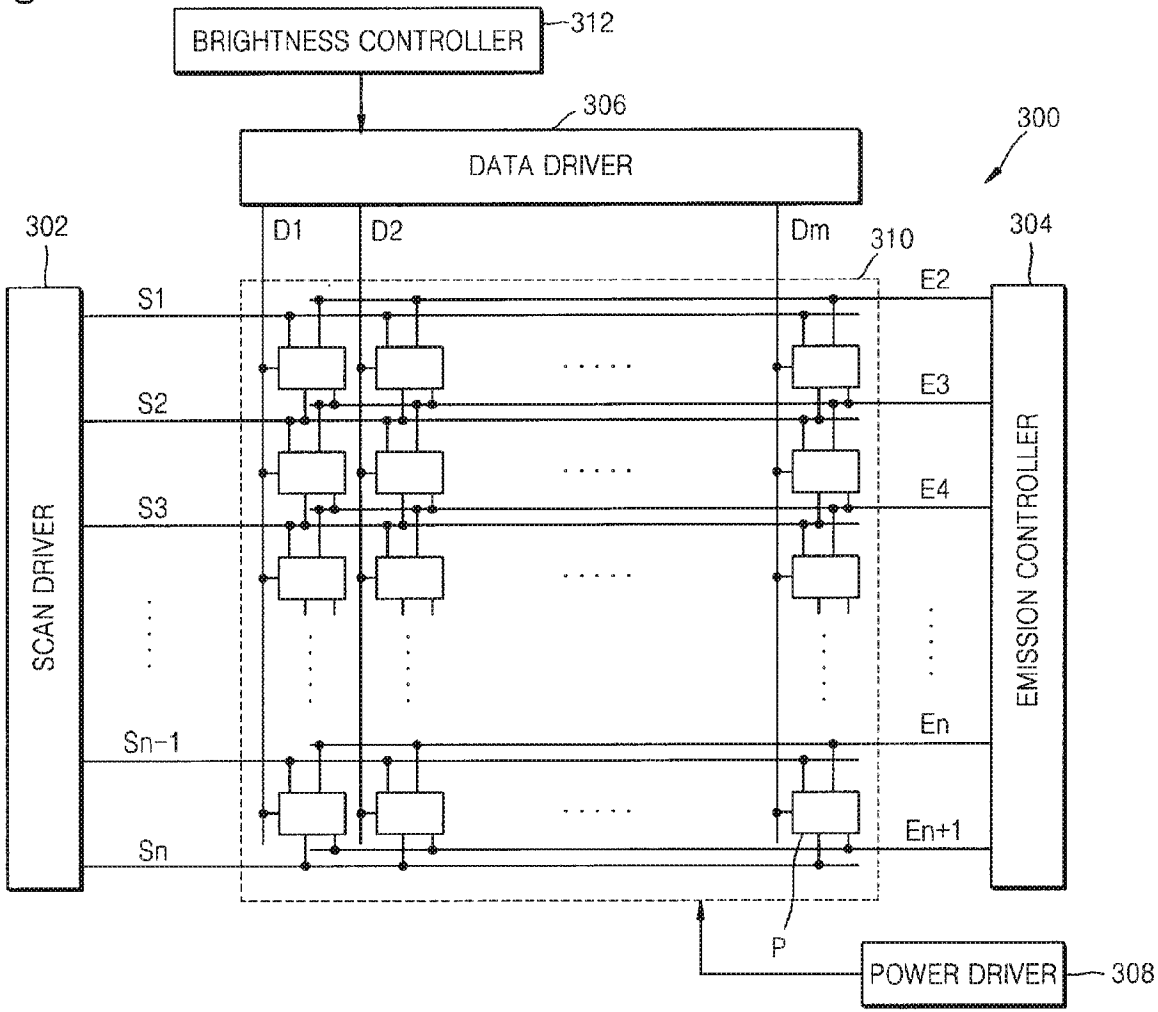
FIG. 3 is a plan view of an organic light-emitting diode (OLED) display device according to an embodiment of the present invention.

FIG. 3 is a plan view of an OLED display device 300 according to an embodiment of the present invention. Referring to FIG. 3, the OLED display device 300 includes a pixel unit (or display region) 310, a scan driver 302, an emission controller 304, a data driver 306, a power driver 308, and a brightness controller 312.

The pixel unit 310 includes n×m pixels P, n scan lines S1, S2, . . . , and Sn, m data lines D1, D2, . . . , and Dm, n emission control lines E2, E3, . . . , and En+1, m first power lines, and m second power lines. The n×m pixel circuits P respectively include OLEDs, and the n scan lines S1, S2, . . . , and Sn are arranged in a row direction and transmit scan signals. The m data lines D1, D2, . . . , and Dm are arranged in a column direction and transmit data signals. The n emission control lines E2, E3, . . . , and En+1 are arranged in a row direction and transmit emission control signals. The m first power lines and the m second power lines transmit electric powers.

The pixel unit 310 emits light through the OLEDs to display an image according to the scan signals, the data signals, the emission control signals, a first power supply voltage ELVDD, and a second power supply voltage ELVSS.

The scan driver 302 is connected to the n scan lines S1, S2, and Sn to apply the scan signals to the pixel unit 310.

The emission controller 304 is connected to the n emission control lines E2, E3, . . . , and En+1 to apply the emission control signals to the pixel unit 310.

The data driver 306 is connected to the m data lines D1, D2, . . . , and Dm to apply the data signals to the pixel unit 310. Here, the data driver 306 supplies the data signals to the n×m pixel circuits P for a programming period.

In the present embodiment, the data driver 306 receives brightness information, which is obtained by adjusting original brightness of a source image to reduce power consumption, from the brightness controller 312, and establishes a voltage of a data signal corresponding to the source image based on the adjusted original brightness.

The power driver 308 applies the first and second power supply voltages ELVDD and ELVSS to each of the n×m pixel circuits P.

The brightness controller 312 transmits the brightness information, which has been adjusted by an ACL algorithm to reduce power consumption, to the data driver 306. Here, the ACL algorithm reduces the brightness according to an emission ratio of the source image to reduce the power consumption. Thus, the ACL algorithm increases a brightness reduction ratio of an image having a high emission ratio to the original brightness of the source image and reduces a brightness ratio of an image having a low emission ratio to the brightness of the source image.

However, if a brightness reduction ratio is greater than original brightness of a source image to reduce power consumption, users may perceive the lowering of an image quality. Thus, the brightness controller 312 of the present embodiment analyzes a saturation of the source image and further increases a brightness reduction ratio only if the saturation of the source image is higher than a set or predetermined reference value, in order to reduce or minimize lowering of an image quality.

Figure 4:
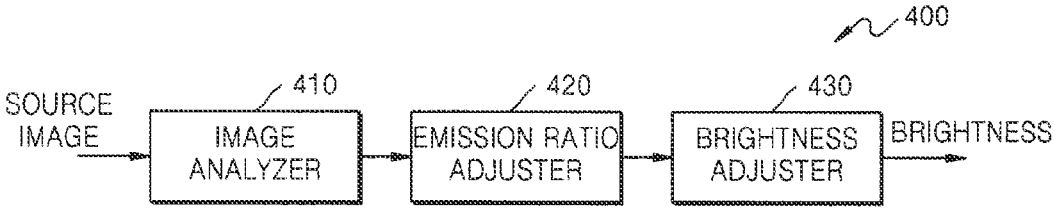
FIG. 4 is a schematic block diagram of a brightness controller of the OLED display device of FIG. 3, according to an embodiment of the present invention.
Figure 5A:
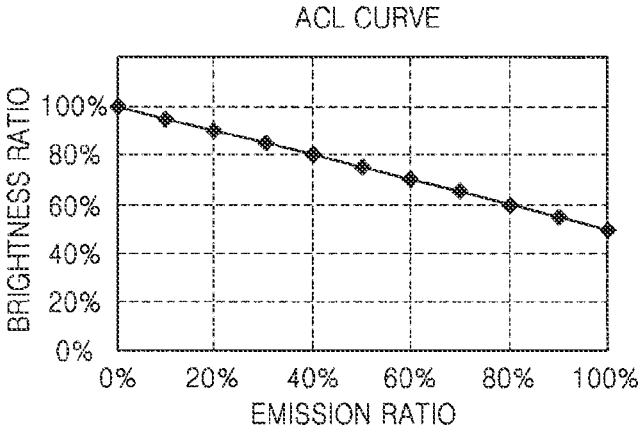
FIGS. 5A and 5B are auto current limit (ACL) applying curves of ACL algorithms according to embodiments of the present invention.
Figure 5B:
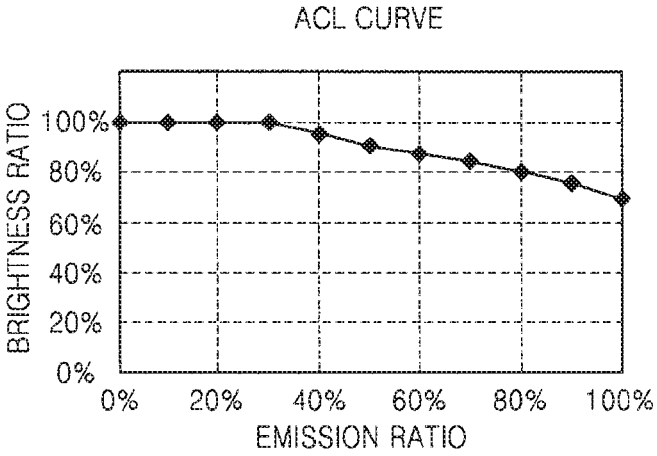

FIG. 4 is a schematic block diagram of the brightness controller 312 of the OLED display device 300 of FIG. 3, according to an embodiment of the present invention. FIGS. 5A and 5B respectively illustrate ACL curves of ACL algorithms, according to embodiments of the present invention.

Referring to FIG. 4, the brightness controller 312 of the OLED display device 300 includes an image analyzer 410, an emission ratio adjuster 420, and a brightness adjuster 430.

The image analyzer 410 analyzes an input source image to obtain an emission ratio and a saturation of the source image.

Here, an emission ratio indicates a ratio of a light-emitted degree of a pixel to a white color. For example, if an emission ratio of a white color (w255) is 100%, an emission ratio of a gray color (w128) may be defined as 50% and an emission ratio of a red color (R225) may be defined as 33%. The numerical values used herein are exemplary and are not limited thereto in the present invention.

In the present embodiment, an average of emission ratio values of pixels constituting the source image is used as the emission ratio of the source image.

The saturation of the source image is an attribute which indicates how much a color separates from a gray color based on the same brightness. In the present embodiment, an average of saturation values of the pixels constituting the source image is used as the saturation of the source image. Here, the algorithm for obtaining the average of saturation values of the pixels can be any suitable algorithm.

The emission ratio adjuster 420 adjusts an emission ratio of the source image according to the saturation of the source image obtained by the image analyzer 410.

If a saturation of a color stimulus varies with the uniform brightness of the color stimulus, the perceived brightness of the color stimulus varies. This phenomenon is referred to as the Helmholtz-Kohlrausch (H-K) effect, which is adopted in the present embodiment.

According to the H-K effect, although two source images have the same luminance, a user perceives the source image having a higher saturation than the other source image to be brighter.

Therefore, if the saturation of the source image is higher than a reference value pre-set in consideration of the H-K effect, the brightness of a color perceived by the user increases. Thus, even if the brightness of an image is actually lowered more than the original brightness of the source image to be displayed, a degree of lowering an image quality perceived by the user decreases (e.g., the image quality perceived by the user is not significantly decreased).

The emission ratio adjuster 420 of the present embodiment applies a pre-set weight to the emission ratio of the source image obtained by the image analyzer 410 and increases the emission ratio in consideration of the H-K effect.

The brightness adjuster 430 adjusts the brightness of the source image using the ACL algorithm. The brightness adjuster 430 adjusts the brightness of the source image according to the emission ratio adjusted by the emission ratio adjuster 420.

For example, the brightness adjuster 430 reduces the brightness of the source image by a brightness reduction ratio proportional to the emission ratio of the source image, according to an ACL curve illustrated in FIG. 5A.

In another embodiment of the present invention, according to an ACL curve illustrated in FIG. 5B, the brightness adjuster 430 reduces the brightness of the source image only if the emission ratio of the source image is equal to or more than a pre-defined reference value. Also, the brightness adjuster 430 does not change the brightness of the source image and maintains the original brightness of the source image if the emission ratio of the source image is less than the pre-defined reference value. This is to maintain the original brightness of a source image which has a low emission ratio and thus does not greatly affect power consumption.

The brightness reduction ratios of the ACL curves illustrated in FIGS. 5A and 5B are exemplary and may be determined experimentally. Also, the brightness reduction ratios may be determined according to peak luminance, gamma, color gamut, and the like of a display device.

For example, an OLED has a higher color gamut than other types of display devices such as an LCD and the like. Thus, although luminance (brightness) is lowered, a color gamut is wide. Thus, a brightness reduction ratio may be set to be high in order to display a general source image having various gray levels.

As described above, according to the present embodiment, an AMOLED having a high color gamut sets a brightness reduction ratio in a low gradation higher than other types of displays such as LCDs or the like. Thus, an ACL algorithm according to the present embodiment may improve a reduction effect of power consumption (e.g., may further decrease power consumption).

Figure 6:
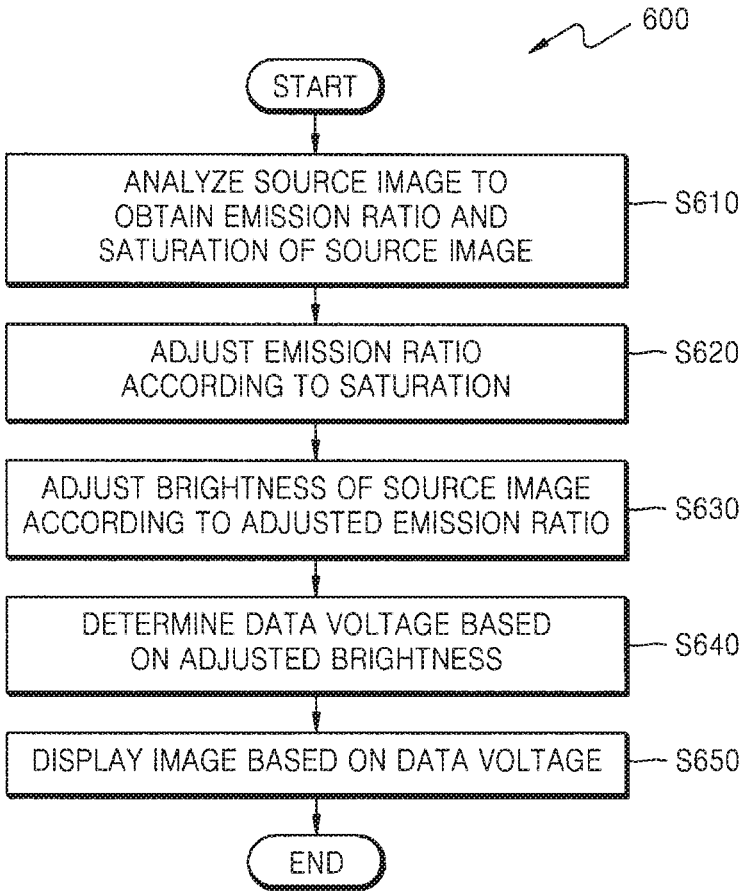
FIG. 6 is a flowchart of a method of driving an OLED display device according to an embodiment of the present invention.

FIG. 6 is a flowchart of a method S600 of driving an OLED display device according to an embodiment of the present invention. The method S600 may be realized in the OLED display device 300 of FIG. 3 and the brightness controller 312 of FIG. 4. Thus, the descriptions of the OLED display device 300 of FIG. 3 and the brightness controller 312 of FIG. 4 also apply to the method S600.

Referring to FIG. 6, in operation S610, an input source image is analyzed to obtain an emission ratio and a saturation of the source image.

The emission ratio refers to a ratio of light-emitted degree of a pixel to a white color, and an average value of emission ratio values of pixels constituting the source image is used as the emission ratio of the source image. The saturation of the source image refers to an attribute which indicates how much a color differs from a gray color based on the same brightness, and an average value of saturation values of the pixels constituting the source image is used as the saturation of the source image.

In operation S620, the emission ratio is adjusted according to the saturation of the source image. If the saturation of the source image is higher than a pre-set reference value in consideration of the H-K effect, a pre-set weight is applied to the emission ratio to increase the emission ratio.

In operation S630, the brightness of the source image is adjusted according to the adjusted emission ratio. In other words, the brightness of the source image may be reduced by a brightness reduction ratio proportional to the emission ratio of the source image according to an ACL algorithm.

In consideration of a source image, which has a low emission ratio and does not greatly affect power consumption, if the emission ratio of the source image is less than a predefined reference value, the brightness of the source image is not changed but the original brightness of the source image is maintained.

In operation S640, a data voltage of a data signal corresponding to the source image is determined based on the adjusted brightness. In operation S650, an image is displayed based on the data voltage.

FIG. 7 is a table illustrating power consumptions in cases in which brightness ratios of source images are adjusted according to an ACL algorithm, according to an embodiment of the present invention. In case (A) in which an ACL algorithm is not adopted, power consumptions of four images (image 1 to 4) are shown. In case (B) in which a general ACL algorithm is adopted, brightness ratios of a source image are adjusted according to emission ratios of the source image, and power consumptions are adjusted according to the adjusted brightness ratios. In case (C) in which an ACL algorithm according to an embodiment of the present invention is adopted, emission ratios of a source image are adjusted according to saturations of the source image, and brightness ratios of the source image are adjusted according to the adjusted emission ratios of the source image. In cases (A), (B), and (C), the brightness ratios are compared with power consumptions.

In the present embodiment, a saturation S is calculated using CIE L*U*V* color coordinates as in Equation 1 below:

$$S=C^*uv/L^* \quad (1)$$

wherein C* denotes a numerical value of chroma of a color, L* denotes a numerical value of brightness of the color, and u and v respectively denote color information on a Green-Red axis on the CIE L*U*V* color coordinates and color information on a Blue-Yellow axis.

If S×uv is greater than 1, an emission ratio is multiplied by a weight greater than 1 to obtain brightness. If S×uv is smaller than or equal to 1, brightness is obtained based on an emission ratio which is not multiplied by a weight.

Referring to FIG. 7, in cases (B) and (C) in which the ACL algorithms are adopted, an effect of considerably reducing power consumption is obtained in comparison with case (A) in which the ACL algorithm is not adopted.

Also, although the brightness of images 2 and 3 having high saturations is adjusted from 75% to 70% in consideration of the H-K effect, a user does not perceive differences in image qualities of the images 2 and 3. Thus, power consumption is reduced more in the case (C) in which the ACL algorithm of the present embodiment is adopted than in the case (B) in which the general ACL algorithm is adopted.

These are only experimental examples, but experiment conditions including weights applied to a brightness reduction ratio and an emission ratio, a reference value of a saturation of a source image, a reference value of an emission ratio of the source image, and the like may be determined according to peak luminance, gamma, color gamut, and the like of a display device.

As described above, in an OLED display device and a driving method thereof according to embodiments of the present invention, lowering of an image quality perceived by a user is reduced or minimized, and a reduction in power consumption is maximized. Thus, a high image quality is obtained, and power consumption is reduced.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light-emitting diode (OLED) display device comprising:

an image analyzer for obtaining an emission ratio and a saturation of an input source image, the emission ratio indicating light-emitted degrees of pixels constituting the input source image;

an emission ratio adjuster for adjusting the emission ratio according to the saturation;

a brightness adjuster for adjusting the brightness of the input source image according to the adjusted emission ratio;

a data driver for establishing a data voltage of a data signal corresponding to the input source image based on the adjusted original brightness; and a pixel unit comprising an organic light-emitting diode (OLED), the pixel unit being configured to establish a driving current according to the data voltage and to receive a scan signal, an emission control signal, and the data signal in order to allow the OLED to emit light, wherein the emission ratio adjuster is configured to increase the emission ratio when the saturation of the input source image is higher than a reference value, and wherein the brightness adjuster is configured to increase a brightness reduction ratio when the emission ratio of the input source image is higher and to decrease the brightness reduction ratio when the emission ratio is lower.

2. The OLED display device of claim 1, wherein the emission ratio is an average of values for indicating the light-emitted degrees of the pixels constituting the input source image.

3. The OLED display device of claim 1, wherein the saturation of the source image is an average of saturation values of the pixels constituting the input source image.

4. The OLED display device of claim 1, wherein the emission ratio adjuster is configured to increase the emission ratio in consideration of the Helmholtz-Kohlrausch (H-K) effect.

5. The OLED display device of claim 1, wherein if the emission ratio of the input source image is lower than the reference value, the brightness adjuster is configured not to change the brightness of the input source image.

6. The OLED display device of claim 1, wherein the brightness adjuster is configured to identify the brightness reduction ratio corresponding to the adjusted emission ratio based on an automatic current limit curve.

7. A method of driving an OLED display device, the method comprising:

obtaining an emission ratio and a saturation of an input source image, the emission ratio indicating light-emitted degrees of pixels constituting the input source image;

adjusting the emission ratio according to the saturation;

adjusting the brightness of the input source image according to the adjusted emission ratio;

establishing a data voltage of a data signal corresponding to the input source image based on the adjusted brightness; and displaying an image corresponding to a scan signal, an emission control signal, and the data voltage, wherein the adjusting of the emission ratio comprises increasing the emission ratio when the saturation of the input source image is higher than a reference value, and wherein the adjusting of the brightness comprises: increasing a brightness reduction ratio when the emission ratio of the input source is higher and decreasing the brightness reduction ratio when the emission ratio of the input source image is lower.

8. The method of claim 7, wherein the emission ratio is an average of values for indicating the light-emitted degrees of the pixels constituting the input source image.

9. The method of claim 7, wherein the saturation of the source image is an average of saturation values of the pixels constituting the input source image.

10. The method of claim 7, wherein the adjusting of the emission ratio comprises: increasing the emission ratio in consideration of the Helmholtz-Kohlrausch (H-K) effect.

11. The method of claim 7, wherein the adjusting of the brightness comprises: maintaining the brightness of the input source image if the emission ratio of the input source image is lower than the reference value.

12. The method of claim 7, wherein the adjusting of the brightness comprises identifying the brightness reduction ratio corresponding to the adjusted emission ratio based on an automatic current limit curve.

13. An organic light-emitting diode (OLED) display device comprising:

means for obtaining an emission ratio and a saturation of an input source image, the emission ratio indicating light-emitted degrees of pixels constituting the input source image;

means for adjusting the emission ratio according to the saturation;

means for adjusting the brightness of the input source image according to the adjusted emission ratio;

means for establishing a data voltage of a data signal corresponding to the input source image based on the adjusted brightness; and means for displaying an image corresponding to a scan signal, an emission control signal, and the data voltage, wherein the means for adjusting the emission ratio comprises means for increasing the emission ratio when the saturation of the input source image is higher than a reference value, and wherein the means for adjusting the brightness comprise: means for increasing a brightness reduction ratio when the emission ratio of the input source image is higher and for decreasing the brightness reduction ratio when the emission ratio is lower.

14. The OLED display device of claim 13, wherein the emission ratio is an average of values for indicating the light-emitted degrees of the pixels constituting the input source image.

15. The OLED display device of claim 13, wherein the saturation of the source image is an average of saturation values of the pixels constituting the input source image.

16. The OLED display device of claim 13, wherein the means for adjusting the emission ratio comprise: means for increasing the emission ratio in consideration of the Helmholtz-Kohlrausch (H-K) effect.

17. The OLED display device of claim 13, wherein the means for adjusting the brightness comprise: means for maintaining the brightness of the input source image if the emission ratio of the input source image is lower than the reference value.

18. The OLED display device of claim 13, wherein the means for adjusting the brightness comprises means for identifying the brightness reduction ratio corresponding to the adjusted emission ratio based on an automatic current limit curve.

* * * * *